US005555460A

United States Patent [19]

Ericsson

[11] Patent Number: 5,555,460

[45] Date of Patent: Sep. 10, 1996

[54] METHOD AND APPARATUS FOR PROVIDING A REFORMATTED VIDEO IMAGE TO A DISPLAY

[75] Inventor: Bo E. Ericsson, San Jose, Calif.

[73] Assignee: Chips and Technologies, Inc., San Jose, Calif.

[21] Appl. No.: 402,159

[22] Filed: Mar. 9, 1995

Related U.S. Application Data

[63] Continuation of Ser. No. 76,497, Jun. 14, 1993, abandoned, which is a continuation of Ser. No. 443,469, Nov. 29, 1989, abandoned.

[51] Int. Cl.[6] ..... G09G 1/00

[52] U.S. Cl. ..... 345/203; 345/3; 345/147

[58] Field of Search ..... 345/154, 155, 345/153, 186, 187, 199, 200, 203, 147, 150, 3

[56] References Cited

U.S. PATENT DOCUMENTS

| | | | |
|---|---|---|---|
| 4,648,050 | 3/1987 | Yamagami | 340/750 |
| 4,712,099 | 12/1987 | Maeda | 345/199 |
| 4,737,772 | 4/1988 | Nishi et al. | 345/153 |
| 4,739,312 | 4/1988 | Oudshoorn | 345/147 |
| 4,799,053 | 1/1989 | Van Aken et al. | 345/199 |
| 4,825,390 | 4/1989 | Van Aken et al. | 345/199 |
| 4,827,255 | 5/1989 | Ishii | 340/703 |
| 4,943,937 | 7/1990 | Kasano et al. | 340/799 |
| 5,028,917 | 7/1991 | Imanishi et al. | 340/793 |
| 5,218,274 | 6/1993 | Zenda | 345/3 |

OTHER PUBLICATIONS

Ferraro, Richard F., *Programmer's Guide to the EGA and VGA Cards*, 1988, p. 45.

*Primary Examiner*—Tommy P. Chin
*Assistant Examiner*—A. Au
*Attorney, Agent, or Firm*—Benman Collins & Swayer

[57] ABSTRACT

A system which allows for the generation of grayscale video signals from color graphics images to grayscaling display devices receiving digital signals. The system is implemented advantageously in packed pixel color graphics modes of a video graphics array sysem utilized in a personal computer. The system is preferably implemented in a software program to decrease the number of hardware components, save circuit board space, consume less power and reduce complexity in the circuitry in the personal computer.

26 Claims, 7 Drawing Sheets

METHOD AND APPARATUS FOR PROVIDING A REFORMATTED VIDEO IMAGE TO A DISPLAY

"This is a continuation of application(s) Ser. No. 08/076,497 filed Jun. 14, 1993, now abandoned which is a continuation of abandoned application Ser. No. 07/443,469 filed on Nov. 29, 1989."

FIELD OF THE INVENTION

This invention is directed toward a system for image conversion and, more particularly, to a system for generating digital grayscale video signals, from color images, for computer controlled monochrome displays.

BACKGROUND OF THE INVENTION

With the advent of personal computers, numerous systems for showing information on displays have been developed and marketed. Display systems allow for application programs to display textual and graphical data on computer displays. Graphics display systems in computers based on International Business Machine's type of personal computers have gone through an evolution from so-called Color Graphics Adapter (CGA) systems to Enhanced Graphics Adapter (EGA) systems to systems that are now known as Video Graphics Array (VGA) systems.

A VGA System operates in two primary video modes. The first mode is the text mode. In text mode, a program that would like to display the character "A" would write the ASCII code (a well known standard coding scheme) into the video memory of the video controller. If a certain color is associated with that letter, a code (called "attribute") representing that color would be written into the next byte location in the video memory. The video controller then rasterizes the letter and color to be output and ensures that it is in synchronization with the various signals.

The second primary mode of video generation is the graphics mode. In the graphics mode each dot or pixel associated with an image must be generated by the CPU. Hence, each dot associated with that image must be stored within the memory space of the CPU and that memory space must be written to by an applications program. Therefore, the graphics mode is slower in the generation of video signals than the text mode.

The present application is directed toward a system for improving the video generation in the graphics mode. Hence, any future reference to mode in the generation of video signals will refer to the graphics mode. Within the graphics mode there are two types of memory organizations from which video signals can be generated—the packed pixel architecture and the planar architecture.

Before there is a complete discussion about these memory organizations, the following paragraphs will describe a typical video graphics array system. A VGA system includes three basic components: (1) a video memory; (2) a VGA controller; and (3) a digital to analog converter (DAC).

The video memory typically holds the image to be displayed on the monitor or other display device. Typically, the video memory contains a plurality of planes of memory. A plane is a section of video memory whose properties are described later in this specification.

The VGA controller is responsible for generating video signals to the display device and for managing all the CPU interface signals. The video signal generation from the controller consists of reading the information in the video memory and then sending the video data to the DAC. As has been mentioned before, the controller allows the CPU interface to be used as a means to read information from and write information into the video memory.

The digital to analog converter (DAC) serves two purposes in a VGA system. First, the DAC contains an internal palette of a plurality of entries which hold color values. In known VGA systems each entry holds color values represented as RGB (red, green and blue) values. Each RGB value is represented by a plurality of bits of information. Second, the DAC contains a functionality to produce three analog signals from a specific RGB value. Based on the input value, generated by the VGA, controller the DAC will look up the corresponding entry, extract the RGB value stored in that entry, and generate three (one red, one green, and one blue) analog signals, which are then sent to the monitor.

Therefore, in a typical VGA system, the following events occur. An address is generated by the VGA controller and placed on the address lines to the video memory. Data is read out of the video memory at the address specified on the address lines. For each time unit, a pixel of information is sent out of the VGA to the DAC. The DAC accesses the internal palette, extracts the appropriate RGB value and converts it to analog signals which are then sent to the monitor or display device. These steps are repeated as long as the VGA system is in an active state.

As has been mentioned before, it has become very popular to distinguish two different types of memory organization: the packed pixel and planar. In the packed pixel memory organization, one pixel is stored in one byte of the video memory. Thus, one pixel is defined by eight bits of information. In this mode 256 ($2^8$) different pixel values (colors) can be displayed simultaneously. As viewed from the programmer, there are no planes (see below for definition of planes) within the video memory. Hence the video memory looks like one contiguous memory space, where the first pixel on the screen is stored in the first memory address of the video memory; the second pixel at the second memory address and so on.

In the planar video memory organization, one pixel is stored in multiple planes of the video memory. Typically, a part of the pixel is stored at the same address location in each plane. All planes are present at the same CPU address. By controlling the registers of the VGA, system the CPU can simultaneously access, through memory read and write cycles, one or more planes. In the planar organization, information is normally accessed from the video memory one plane at a time.

To generate video information from the planar organization, the VGA controller generates an address to the memory, reads the information from the respective planes (bytes) and assembles the pixels from the bytes in the planes. In a typical VGA planar mode, eight pixels are defined by one byte in each plane. Bit 7 of the bytes in each plane defines pixel O; Bit 6 in the bytes of each plane defines pixel 7, and so on. The number of available planes determines the number of bits per pixel. Hence, if there are four planes, sixteen ($2^4$) different pixel values (color) can be displayed; if there are three planes, eight ($2^3$) colors can be generated, and so on.

It is known that within the graphics mode there are several video modes. In each of these video modes the color of a specific pixel on a screen of the monitor is determined by the RGB value stored in one of the locations within the DAC of the VGA system. After the pixel has left the VGA controller and entered the DAC, it receives the color value. Before this point, the pixel data only contains an address into the DAC, not the color value itself.

In VGA systems utilized for grayscaling and monochrome flatpanels, using LCD, gas plasma or electro-luminescent technologies, the DAC cannot directly drive the display. The DAC cannot drive these types of displays because these types of displays receive a digital signal of the grayscale information, whereas the DAC generates an analog color signal. Grayscale video information is derived from color video information upon which a grayscaling algorithm is applied. The grayscaled video information can contain any number of bits, depending on the grayscaling capabilities of the display device. One bit per pixel defines two grayscale levels: (black (0) or white (1). Two bits per pixel define four ($2^2$) grayscale levels. Three ($2^3$) and four ($2^4$) bits per pixel define eight and sixteen levels respectively.

Most video modes of the VGA (modes 0 through 12 hexadecimal) are programmed in such a way that the colors stored in the DAC will have no effect on the generated image when displayed on standard monitors. That is, in these modes the DAC performs no alteration of the colors of the pixels generated by the VGA. That means that a digital display device connected directly to the digital video output of the VGA will display the same colors as an analog monitor connected to the analog output of the DAC.

However, in the packed pixel video mode, mode 13 hex, the DAC performs a significant alteration of the video stream generated by the VGA. In this mode, the internal palette in the DAC is often programmed by software applications to hold color values specific for each individual image to be displayed. Thus, in this video mode the digital value produced by the VGA is merely an address into the DAC and cannot be used by itself to drive a display device.

It is important in a video graphics array system to provide a system for ensuring that color graphics video modes are accurately displayed on a grayscaling display device. Likewise, it is important to provide a VGA system that includes a system for ensuring that a video mode that utilizes the packed pixel memory organization be accurately displayed on such non-color display devices. The system should be such that it is inexpensive, uses little power, and takes up little or no surface area on the VGA system or personal computer.

SUMMARY OF THE INVENTION

The present invention is an improved VGA system for accurately displaying the grayscale equivalent of a color image, stored in packed pixel memory organization, without using any external grayscaling hardware. The VGA system includes a memory having a plurality of planes for storing digital information, a controller for controlling the movement of the digital information and a converter (preferably a digital to analog converter (DAC)) for converting the digital information into video address information.

The improvement to the VGA system comprises a system that performs the following steps: drawing an image into first portion of the memory, computing the grayscale value of the image reformatting the grayscale value of the image, writing the reformatted grayscale value to an unused portion of the memory, generating the reformatted grayscale value of the image from the unused portion of the memory and preventing the generating of video information from the first portion of the memory.

The invention is preferably implemented in a software program. Therefore, the invention requires no extra hardware, takes up no area in the VGA system and does not contribute to any power consumption. Hence, through the use of the present invention, video modes that heretofore have been difficult to display when a digital signal drives the monitor are now easy to implement.

DETAILED DESCRIPTION

The present invention relates to an improvement in the generation of video signals in the graphics mode. The following description is presented to enable one of ordinary skill in the art to make and use the invention and is provided in the context of a particular application and its requirements. Various modifications to the preferred embodiment will be readily apparent to those skilled in the art, and the generic principles defined herein may be applied to other embodiments. Thus, the present invention is not intended to be limited to the embodiment shown but is to be accorded the widest scope consistent with the principles and novel features disclosed herein.

Figure 1:
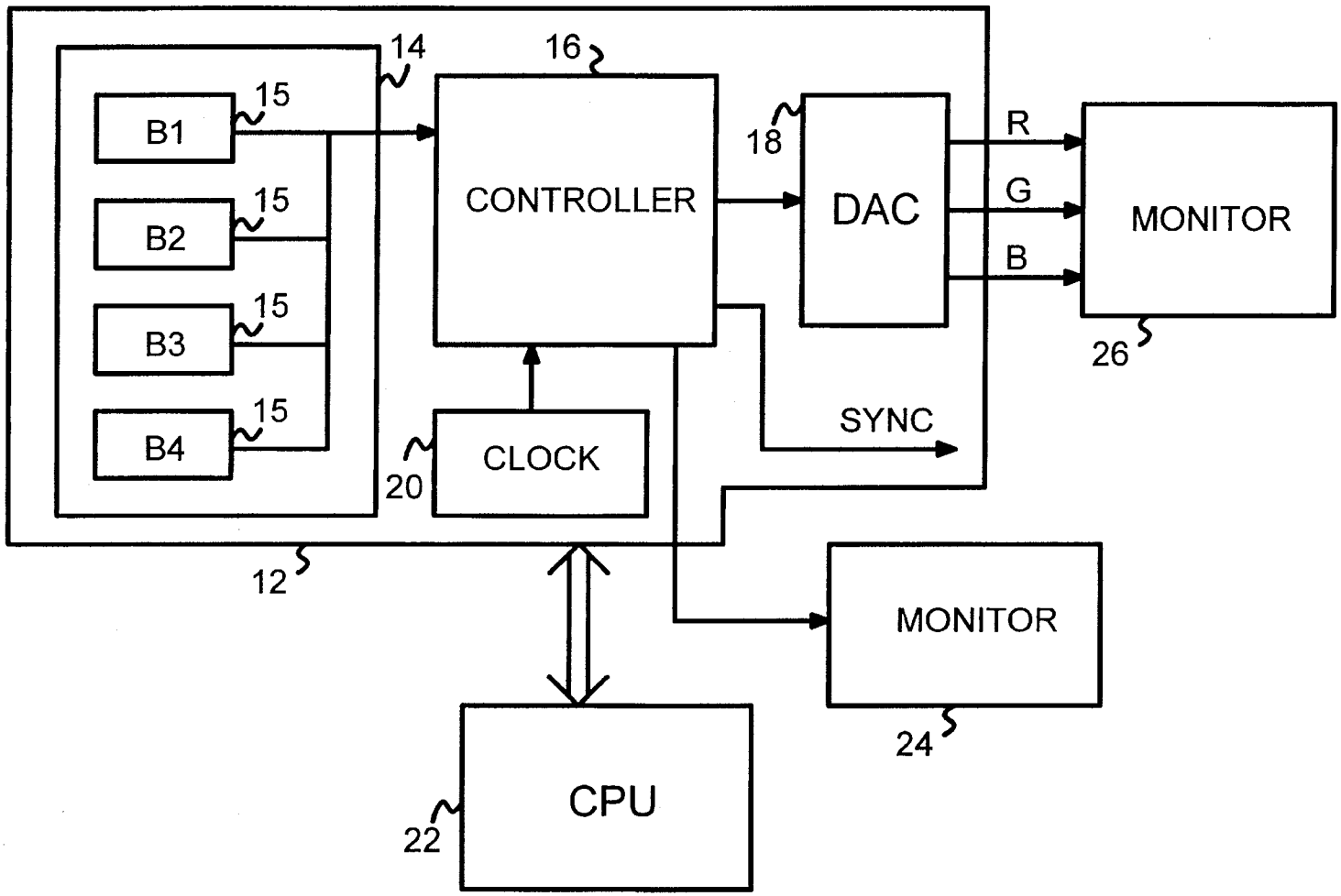
FIG. 1 is a block diagram of a typical system for generating video information in the graphics mode.

Referring now to FIG. 1, what is shown is a typical video graphics array (VGA) system 12 coupled to a central processing unit (CPU) 22 and display devices 24 and 26. The VGA system 12 under control of the CPU 22 produces images to be displayed on display devices 24 and 26.

The VGA system 12 comprises a video memory 14 (which includes a plurality of planes 15 (B0–B3) coupled in parallel which is in turn coupled to a controller 16. The controller receives clock signals from "dot" clock 20 and also is coupled to a digital to analog converter (DAC) 18. The DAC 18 converts digital signals from the controller 16 to analog signals, based on an internal color palette, and drives display device 26. Many display devices require digital signals to display images. Hence, as is shown, a digital signal is derived directly from the controller 16 to display device 24 so that images can be displayed on display device 24.

In this embodiment the video memory 14 comprises a plurality of banks 15 (B0–B3) in the video memory. Each bank can typically hold 64 kilobytes (KB) of memory and the total memory storage area is 256 KB. Although four banks are shown, it should be understood, however, that there can be any number of banks 15 in the video memory and that different number would be within the spirit and scope of the present invention.

To explain further the operation of the above-identified VGA system, the term "plane" will be defined. As has been before-mentioned, there are a plurality of banks 15 in the video memory which are typically a physical group of random access memories (RAM). A plane represents a portion of the video memory.

Figure 2:
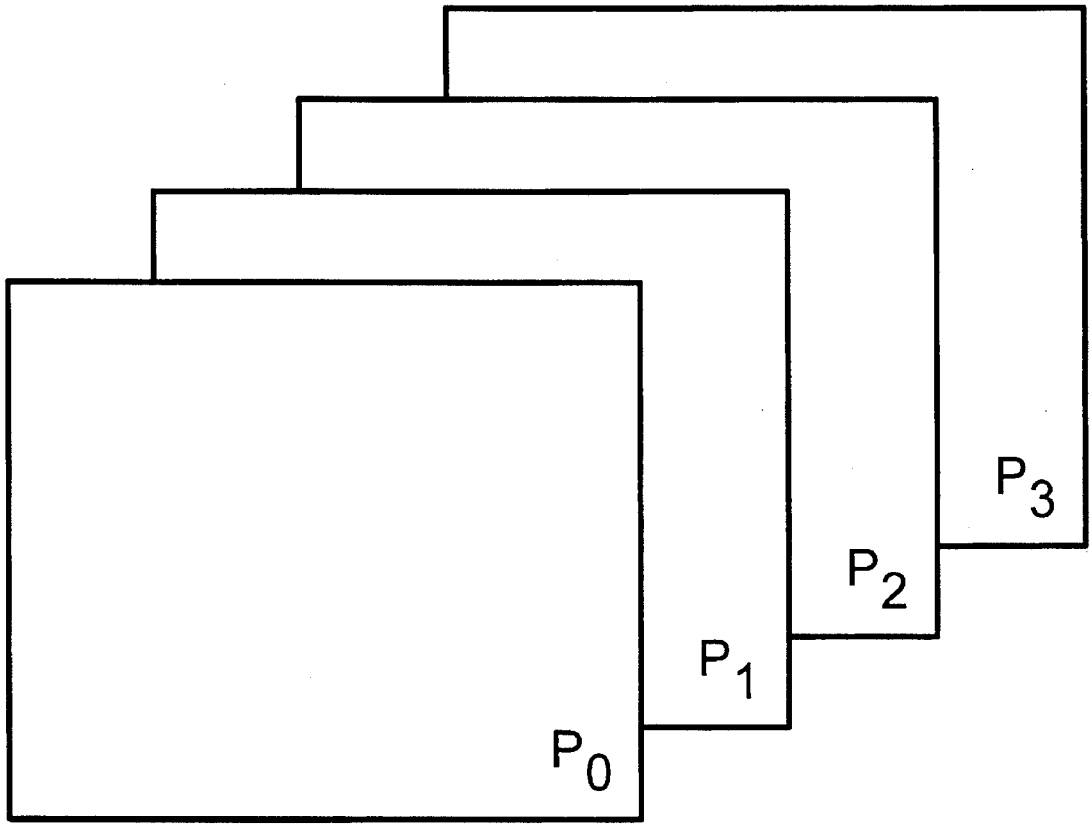
FIG. 2 is a representation of the planes of memory in the system of FIG. 1.

Referring now to FIG. 2 shown are four planes of memory (P0–P3). In this embodiment, four planes are utilized; however, one of ordinary skill in the art will recognize that a different number of planes could represent the video memory and that would be within the spirit and scope of the present invention. Each of these planes represents a part of the color information of the image. These planes can be configured into two types of memory organizations, packed pixel and planar.

Figure 3:
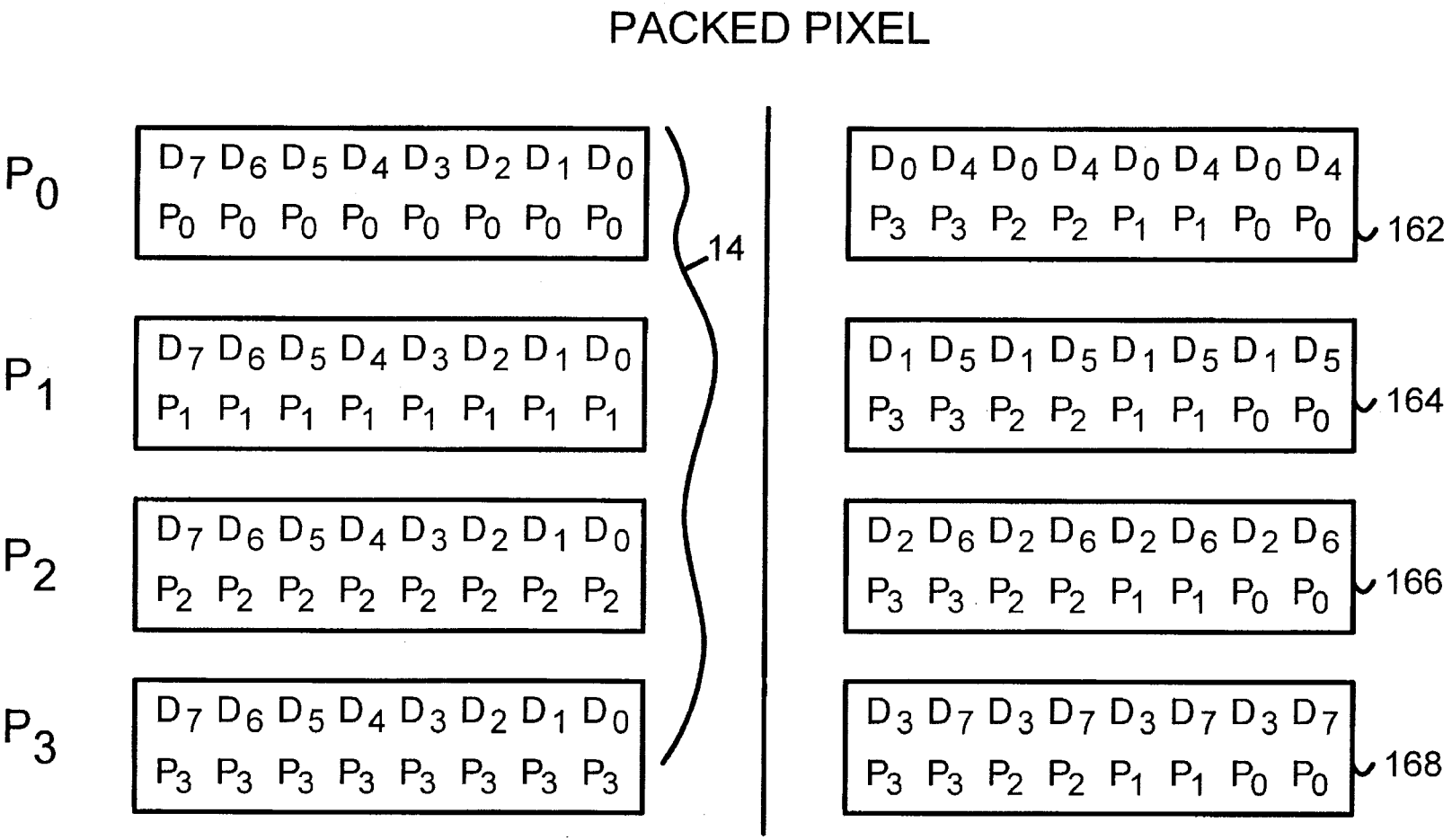
FIG. 3 depicts a packed pixel memory organization in a VGA system.
Figure 4:
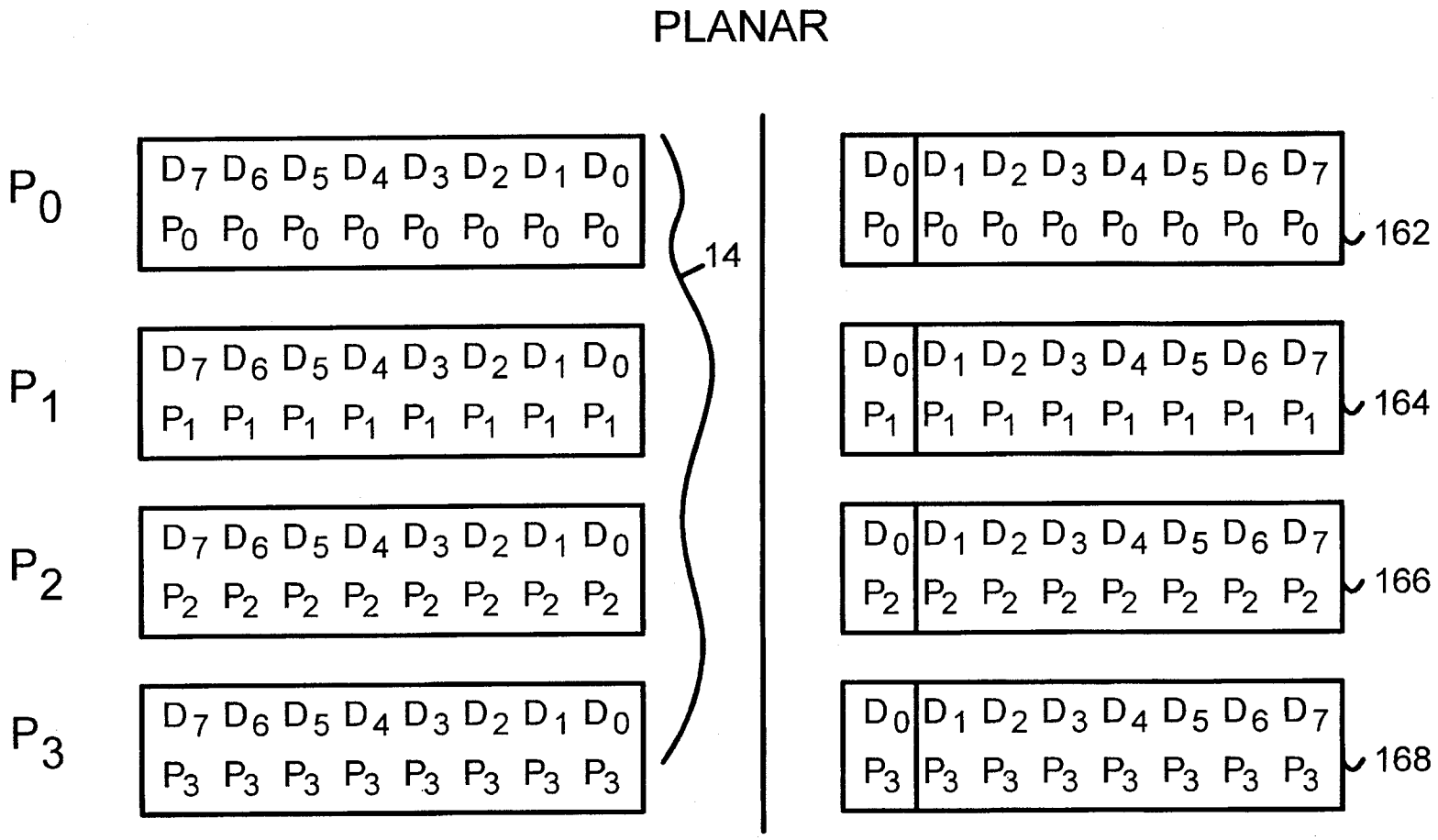
FIG. 4 depicts a planar memory organization in a VGA system.
Figure 5:
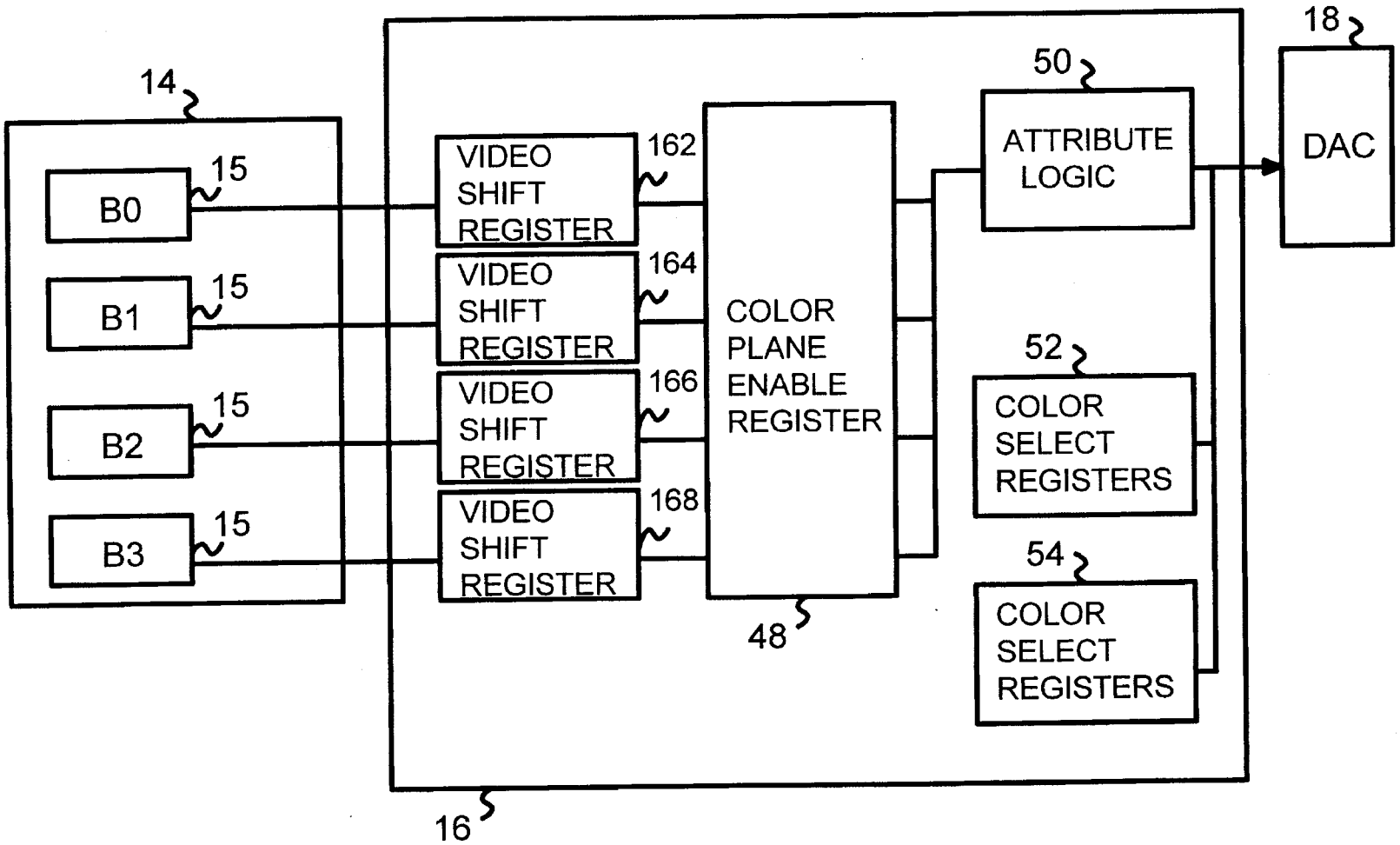
FIG. 5 depicts a portion of the VGA system during the video generation process.

To further describe the environment of the present invention, the next few paragraphs in conjunction with FIGS. 3–5 will describe the two major types of memory organizations of the VGA system of FIG. 1. FIG. 3 depicts a packed pixel architecture. FIG. 4 depicts a planar architecture. FIG. 5 depicts a portion of the video memory 14, internal registers of the VGA controller 16, color plane enable register 48, attribute logic 50, and two color select registers 52 and 54.

The color plane register 48, attribute logic 50, and color enable registers 52 and 54 have been depicted in block diagram form. It is well known that these elements can comprise a variety of types of logic circuits. To understand the present invention, it is not necessary to describe the specific implementation of these elements and hence any further explanation concerning these elements will be their function in relation to the below described video modes.

Packed Pixel Memory Organization

In the packed pixel memory organization, one pixel is stored in one byte of the video memory 14 (FIG. 1). From the programmer point of view, the memory 14 is one contiguous memory space. Thus, in this memory organization the image is stored in all four planes. To generate four pixels utilizing this memory organization, the controller 16 generates an address signal to the video memory 14. At this location four different pixels are stored, one in each plane (P0–P3). The controller 16 reads those pixels and then buffers them internally. Then responsive to the next four clock signals from the dot clock 20, it sends one pixel at a time to the DAC 18.

FIG. 3 depicts the shifting of pixels of information from video memory 14 into video shift registers 162, 164, 166, 168 of the VGA controller 16. In packed pixel mode 13, video information is generated in the following way: At regular intervals (every 4 pixel times) new pixel data is loaded into the VGA controller 16 from the video memory 14. Four adjacent pixels are stored at the same address in the four planes (P0–P3) of the video memory 14.

In this embodiment, the first pixel is stored in the first plane, the second in the second plane, etc. The video shift registers 162, 164, 166, 168 of the VGA controller 16 are loaded in such a way that the first pixel is shifted out first, the second pixel is shifted out next until all of the pixels are shifted out of the VGA controller 16. Since the internal data path of the VGA controller 16 is only four bits wide, and since the pixel is defined by 8 bits, a nibble (4 bits) at a time must be shifted through the VGA Controller 16.

The upper nibble of each pixel is shifted out first (D4–D7), then the lower nibble of each pixel is shifted out next. The upper nibble is stored at the end of the attribute logic 50 (FIG. 5) (D0–D3), and is joined by the lower nibble when the lower nibble is shifted through the attribute logic 50. The color plane enable register 50 is not used in packed pixel mode 13.

No alteration to the 2 four bit values are performed by the attribute logic 50 in packed pixel mode 13. The VGA controller 16 then outputs the resultant 8 bit pixel quantity from the VGA into the external DAC 18. For the duration of one pixel time (two internal clock cycles) the 8 bit value is output from the VGA controller 16.

Planar Memory Organization

In planar memory organization, one pixel is stored in multiple planes of the video memory 14. In this type of organization, each pixel is represented by four bits of video information. Hence, eight adjacent pixels are stored in four bytes located at the same address in the four planes of memory 14. To access the video memory 14, control registers (not shown) are used to select the specific plane to be accessed.

To generate video signals from this memory organization, the controller 16 generates an address to the memory 14. It then reads four bytes from the memory 14 and assembles eight four-bit pixels. In this embodiment, the first pixel is defined by bit 7 in each plane. The next pixel is defined by bit 6 in each plane and so on and so forth until each pixel is generated.

FIG. 4 depicts the shifting of pixels of information into video shift registers 162, 164, 166, 168 in planar mode. In planar video mode, video is generated in the following way: At regular intervals (every 8 pixel times) new pixel data is loaded into the VGA controller 16 from the video memory 14. Eight pixels are defined by the 4 bytes located at the same address in the video memory 14. Thus, every pixel is defined by 4 bits. Each pixel is defined by a specific bit in each byte in the four planes.

Referring again to FIG. 5, the internal shift registers 162, 164, 166, 168 of the VGA controller 16 are loaded in such a way that the first pixel is shifted out first, the second pixel is shifted next. The pixel then passes through the color plane enable register 50. In this video mode the register 48 acts as a mask which can disable individual pixel bits from specific planes.

The pixel information is then shifted into the attribute logic 48. Here an internal palette of 16 entries, each 6 bits wide, is used to transform the 4 bit input value to a 6 bit output value. This 6 bit value is supplemented by 2 bits from the color select registers 52 and 54 to form an 8 bit value. This value is output from the VGA controller 16 and sent to the external DAC 18.

In describing the operation of a VGA system in a computer, only those elements that are necessary for an understanding of the present invention have been described in detail. It is understood by one of ordinary skill in the art that there are other elements within the VGA system that must be present to provide an efficiently operating system.

Now referring back to the overall operation of the VGA system, the controller 16 is responsible for both generating video signals to display devices 24 and 26, and managing the CPU interface. The controller 16 reads the information out of the video memory 14 and sends the video information to the DAC 18. The CPU interface allows an application program from the CPU 22 to write into and read from the video memory 14.

The DAC 18 contains a palette which has a plurality of entries. In a typical VGA system, a palette contains 256 entries. Each entry in turn contains a color value. These values are typically called RGB values for the primary colors red, blue and green. In a preferred embodiment each component of the value (R, G and B) individually contains 6 bits of information. Hence, each RGB value comprises 18 bits of information. For each digital input from the controller 16, the DAC 18 looks up a corresponding RGB value. Based upon this RGB value, the DAC 18 produces three analog signals (R, G and B), which are sent to monitor 26.

Therefore, to generate video signals to be displayed by monitor 26, the following sequence of events occur:

1. An address signal into the video memory 14 is generated by the controller 16.
2. Data is read out of memory 14 and into the VGA controller 16.
3. For each clock cycle initiated by clock 20, a pixel of information is sent out of the VGA as a digital value to the DAC.
4. The corresponding RGB value is selected.
5. The three analog signals are formed and sent to the monitor 26.
6. Thereafter steps 1 through 5 are repeated.

This system works effectively for generating the analog signals to be displayed by display device 26. However, this system cannot be used for display device 24 in which digital signals are required to produce the image. These types of monitors require a digital video signal of grayscale information.

As has been mentioned before the RGB value stored in one of the entries of the DAC 18 will determine the color of a specific pixel. After the digital information representing that RGB value enters the DAC, the pixel is assigned a color value. In other words, the digital information entering the DAC 18 represents an address into the DAC, which will become an RGB value after leaving the DAC 18.

The DAC 18 does not directly drive the grayscaling display device 24. This display device 24 requires a digital video signal that comprises the grayscale equivalent of the analog RGB value, and is driven directly by the VGA. It is known that there is a certain graphic video mode, mode 13 hex, in which the color of a pixel is defined first in the DAC 18. By bypassing the DAC 18, where the colors are defined, the resultant image displayed on the grayscaling display device 24 will be distorted.

The present invention is directed to a system for ensuring that the packed pixel image created by a VGA system is displayed on a digital grayscaling display device accurately.

Figure 6:
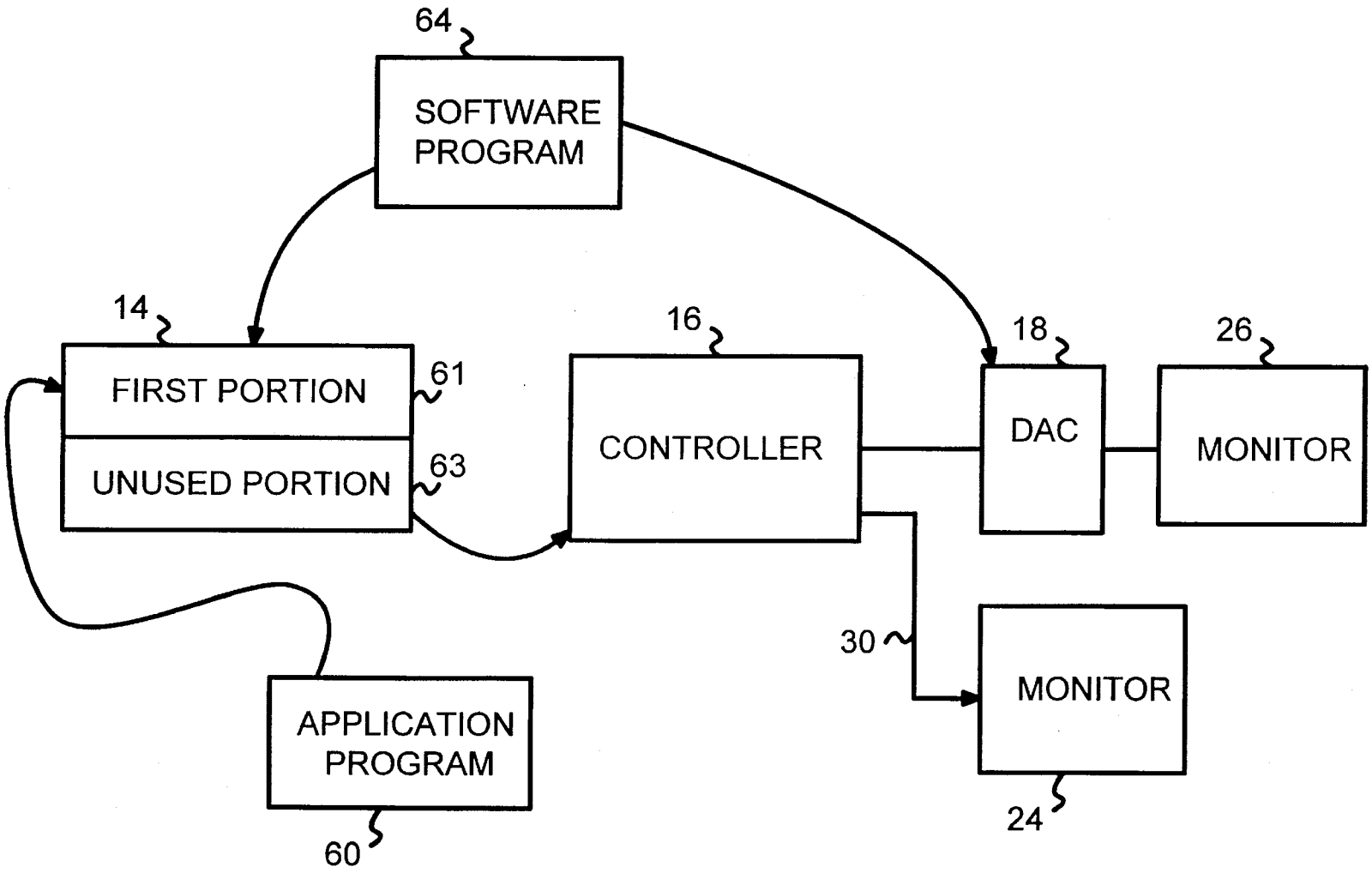
FIG. 6 is a system diagram of a system in accordance with the present invention.

Referring now to FIG. 6, what is shown is a system diagram of the operation of the VGA system in accordance with the present invention. Shown is the VGA controller 16, the DAC 18 and display devices 24 and 26 of FIG. 1. What is also shown is an application program 60 which will reside in the CPU memory address space, the video memory 14 and the system 64 of the present invention. The system 64 uses to advantage the unused video memory space 63 of video memory 14 to allow for the generation of an image that does not have a grayscale equivalent within the DAC 18.

In this embodiment, the application program 60 draws an image into the first portion of the memory 14 at location 61. The system 64 will then read one pixel of that image from the video memory 14. It will read the pixel color from the DAC 18 and compute a grayscale value, based on a grayscale algorithm. That grayscale value is then written into the unused video memory portion 63. Then that grayscale information is handled by the VGA controller 16 and delivered to the display device 24. In this embodiment the display device 24 can be a so-called "flatpanel" display device utilized to display monochrome or grayscale images. Through the use of this system 64, a video mode which has heretofore been poorly displayed on digital monitors can now be accurately displayed.

Figure 7:
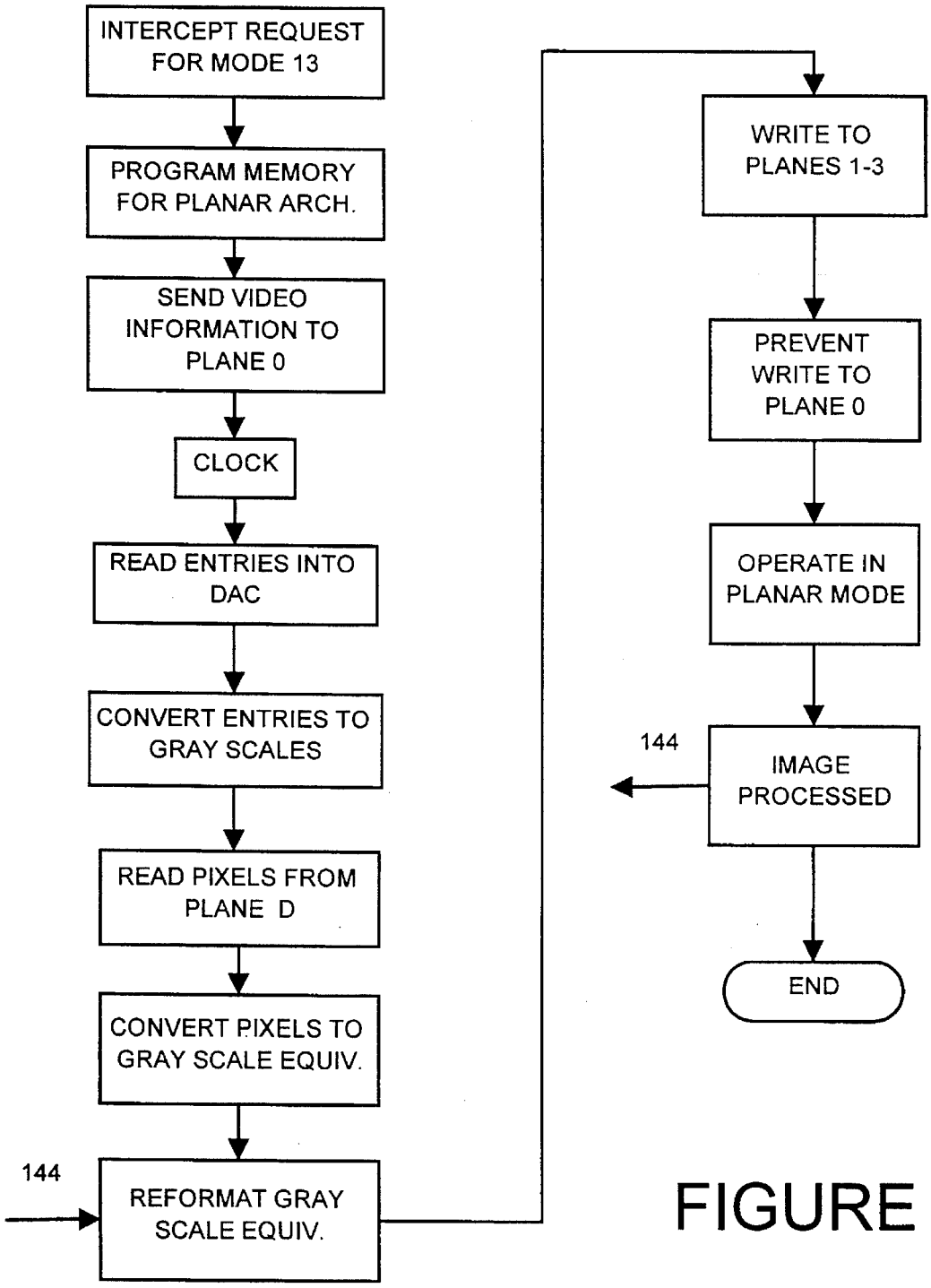
FIG. 7 is a flow chart showing the operation of the preferred embodiment of the present invention.

To provide a more specific embodiment, refer now to FIG. 7. In FIG. 7, shown is a flow chart of a system to achieve the above-identified result. The present invention is described in terms of mode 13 in FIG. 3, but one of ordinary skill in the art should recognize that future video modes may also be improved by the invention. The basic purpose of the system depicted by the flow chart is to convert an image drawn by an application program to the grayscale equivalent in real time.

Whenever a mode 13 initialization request is issued by the application program to the computer system software embedded in the read only memory (ROM), called Video Basic Input/Output System (BIOS), the request is intercepted (box 100) by the system of the present invention. The present invention then programs the VGA system 12 (FIG. 1) for planar organization (box 104) rather than packed pixel architecture as would normally happen. Thereafter, the present invention causes the controller 16 to direct video information from the application to plane 0 only of the video memory (box 108).

The present invention then allows plane 1–3 to be accessed by the controller for video generation and prevents plane 0 from being used (box 138). The present invention continues to cause the controller to operate in the planar mode so as to read the information out of planes 1–3 (box 138).

Thereafter at regular intervals, the present invention is invoked by the computer clock (box 112) to initiate a grayscaling refresh cycle. The system then reads the contents of the DAC and converts the entries of the DAC into grayscale values (boxes 116 and 118). In a typical system each gray shade is defined by 3 bits, thereby creating eight different shades of gray. Since plane 0 is used to hold the packed pixel video image, three other planes are available in an ordinary VGA system. Thus $2^3=8$ gray levels can be generated. Thereafter, the system reads the first eight pixels from the image stored in plane 0 (Box 124) .

Then those eight pixels are converted into their grayscale equivalents using the grayscale equivalent of the DAC, stored in the program workspace. The color of each pixel is thereby converted into a 3-bit grayscale value. The grayscale values are then reformatted to be written into the video memory in the planar mode (box 132). Planes 1–3 will be written.

The present invention will repeat blocks 132, 136 and 138 until the image is completely processed (decision box 142). The system can then be invoked again by the clock (box 112) to start a new refresh cycle. Through the use of the above identified system, a visually correct color image can be displayed on a display device that is driven by a digital signal without significantly increasing the cost or complexity of the VGA system.

In a preferred embodiment, the present invention of FIG. 6 or FIG. 7 is a software program that is resident within the CPU. The program has the advantage of not requiring any new hardware or take up additional space in the system as well as not consuming additional power. In addition, a hardware embodiment would require format and timing synchronization. This could also add significant complexity to the VGA system. These may all be of significant commercial importance if the present invention is utilized in "laptop" or "notebook" type personal computers. Therefore, at the present time, this type of system is advantageously implemented in software.

It will be understood, however, by one of ordinary skill in the art that the present invention could be readily implemented in hardware components. As the technology develops, the above-mentioned disadvantages may be overcome. In so doing, many of the aforementioned advantages of the present invention could still be readily obtained.

It is understood that the above-described embodiment is merely illustrative of but a small number of the many possible specific embodiments which can represent applications of the principles of the present invention. Numerous and various other arrangements can be readily devised in accordance with these principles by one of ordinary skill in the art without departing from the spirit and scope of the present invention. The scope of the present invention is limited only by the following claims:

What is claimed is:

1. In a video graphics array (VGA) system, the VGA system includes a single memory for storing digital information, controller means for controlling the movement of the digital information and converter means for converting the digital information into video information in the form of a color value, a method for providing a grayscale equivalent of the color value to a display, the method comprising the steps of:

(a) configuring the VGA system for planar organization;

(b) drawing an image into a first portion of the single memory with a packed pixel arrangement;

(c) computing a grayscale value of the image in accordance with the color value;

(d) reformatting the grayscale value of the image;

(e) writing the reformatted grayscale value of the image to an unused portion of the single memory with a planar arrangement;

(f) generating the reformatted grayscale value from the unused portion of the single memory; and (g) preventing the output of the video information of the image from the first portion of the single memory.

2. The method of claim 1 in which the converter means comprises a digital to analog converter wherein the color value is further translated to an analog output.

3. The method of claim 1 in which the single memory comprises a plurality of banks of random access memories that are coupled in parallel and have a common output.

4. The method of claim 1 in which the first portion is a first plane of the single memory.

5. The method of claim 1 wherein the unused portion comprises at least one other plane of the single memory.

6. The method of claim 1 wherein the unused portion comprises a plurality of other planes of the single memory.

7. The method of claim 1 wherein the unused portion comprises three other planes of the single memory.

8. The method of claim 5 in which the video graphics array system further includes means for receiving the generated reformatted grayscale value from the at least one other plane of the single memory means and displaying the image represented by the reformatted grayscale value.

9. The method of claim 6 in which the video graphics array system further includes means for receiving the reformatted grayscale value from the other planes of the single memory and displaying the image represented by the reformatted grayscale value.

10. The method of claim 1 wherein the color value is an RGB value.

11. In a video graphics array (VGA) system, the VGA system includes a single memory for storing digital information, controller means for controlling the movement of the digital information and converter means for converting the digital information into video information in the form of a color value, an apparatus for providing a grayscale value equivalent to the color value, the apparatus comprising:

means for configuring the VGA system in a planar organization;

means for drawing an image into a first portion of the single memory with a packed pixel arrangement;

means for computing the grayscale value of the image in accordance with the color value;

means for reformatting the grayscale value of the image;

means for writing the reformatted grayscale value of the image to an unused portion of the single memory with a planar arrangement;

means for generating the reformatted grayscale value from the unused portion of the single memory; and means for preventing the output of the video information of the image from the first portion of the single memory.

12. The apparatus of claim 11 in which the converter comprises a digital to analog converter wherein the color value is further translated to an analog output.

13. The apparatus of claim 11 in which the single memory comprises four banks of random access memories that are coupled in parallel and have a common output.

14. The apparatus of claim 11 in which the first portion is a first plane of the single memory.

15. The apparatus of claim 11 wherein the unused portion comprises at least one other plane of the single memory.

16. The method of claim 11 wherein the unused portion comprises a plurality of other planes of the single memory.

17. The apparatus of claim 11 wherein the unused portion comprises three other planes of the single memory means.

18. The apparatus of claim 11 wherein the color value is an RGB value.

19. In a video graphics array (VGA) system, the system includes a single memory having a plurality of planes for storing digital information, means for controlling the movement of the digital information and means for converting the digital information into video information in the form of a color value, an apparatus for providing a grayscale equivalent to the color value to provide accurately an image to a display, the system comprising:

(a) means for configuring the planes of the single memory into a planar memory organization;

(b) means for drawing an image in a first plane with a packed pixel arrangement;

(c) means for computing a grayscale value of the image in accordance with the color value;

(d) means for reformatting the grayscale value of the image;

(e) means for storing the reformatted grayscale value in a second plane with a planar arrangement;

(f) means for generating a video output from the reformatted grayscale value; and (g) means for preventing the generation of the video output from the first plane.

20. The apparatus of claim 19 in which the converter means comprises a digital to analog converter wherein the color value is further translated to an analog output.

21. The apparatus of claim 19 in which the single memory comprises four banks of random access memories that are coupled in parallel and have a common output.

22. The apparatus of claim 19 in which the color value is an RGB value.

23. The apparatus of claim 19 wherein at least one other plane of the plurality of planes is used to store the reformatted grayscale value for a generation of a video information.

24. The system of claim 19 wherein the color value is an RGB value.

25. In a video graphics array (VGA) system, the VGA system includes a single memory for storing digital information, controller means for controlling the movement of the digital information and converter means for converting the digital information into video information in the form of a color value, a method for providing a grayscale equivalent of the color value to a display, the method comprising the steps of:

(a) configuring the VGA system for planar organization;

(b) drawing an image into a first portion of the single memory with a packed pixel arrangement, the packed pixel arrangement having each pixel defined by a first plurality of bits;

(c) computing a grayscale value of the image in accordance with the color value;

(d) reformatting the grayscale value of the image;

(e) writing the reformatted grayscale value of the image to an unused portion of the single memory with a planar arrangement, the planar arrangement having each pixel defined by a second plurality of bits; the first plurality of bits being larger than the second plurality of bits;

(f) generating the reformatted grayscale value from the unused portion of the single memory; and (g) preventing the output of the video information of the image from the first portion of the single memory.

26. The video graphics array (VGA) system of claim 25 in which the first plurality of bits include 8 bits and the second plurality of bits include 4 bits.

* * * * *